US011926886B2

(12) United States Patent
Zhan et al.

(10) Patent No.: US 11,926,886 B2
(45) Date of Patent: Mar. 12, 2024

(54) GRAIN REFINER FOR MAGNESIUM-BASED ALLOYS

(71) Applicant: GM GLOBAL TECHNOLOGY OPERATIONS LLC, Detroit, MI (US)

(72) Inventors: Henry Zhan, Shanghai (CN); Congjie Wang, Shanghai (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/565,634

(22) Filed: Dec. 30, 2021

(65) Prior Publication Data

US 2022/0205068 A1 Jun. 30, 2022

(30) Foreign Application Priority Data

Dec. 30, 2020 (CN) ..... 202011600476.0

(51) Int. Cl.
*C22C 23/02* (2006.01)
*C22C 1/03* (2006.01)

(52) U.S. Cl.
CPC ..... *C22C 23/02* (2013.01); *C22C 1/03* (2013.01)

(58) Field of Classification Search
CPC ..... C22C 1/03; C22C 23/02
USPC ..... 420/438
See application file for complete search history.

(56) References Cited

U.S. PATENT DOCUMENTS 6,395,224 B1 5/2002 Nishino et al.
7,465,333 B1 12/2008 Halalay et al.
7,919,174 B2 4/2011 Ruokolainen et al.
8,052,224 B2 11/2011 Luo et al.
8,328,971 B2 12/2012 Kia et al.
2009/0226755 A1 9/2009 Sigler et al.
2010/0092790 A1 4/2010 Luo et al.
2010/0290942 A1 11/2010 Becker et al.
2013/0121869 A1 5/2013 Kulkarni et al.

FOREIGN PATENT DOCUMENTS

CN 109097614 A * 12/2018 ..... C22C 1/03
CN 114686710 A 7/2022
DE 102021114769 A1 6/2022
KR 20150077494 A 7/2015

(Continued)

OTHER PUBLICATIONS

NPL: Online translation of KR 20150077494 A, Jul. 2015 (Year: 2015).*

(Continued)

*Primary Examiner* — Jie Yang

(74) *Attorney, Agent, or Firm* — Harness, Dickey & Pierce, P.L.C.

(57) ABSTRACT

A master alloy including an alloy composition including magnesium (Mg) at a concentration of greater than or equal to about 1.00 wt. % to less than or equal to about 90 wt. %, boron (B) at a concentration of greater than or equal to about 0.01 wt. % to less than or equal to about 20 wt. %, and aluminum (Al) at a concentration of greater than or equal to about 0.1 wt. % to less than or equal to about 90 wt. %, wherein the alloy composition includes $MgB_2$ particles at a volume fraction greater than or equal to about 0.01% to less than or equal to about 20%.

5 Claims, 4 Drawing Sheets

(56) References Cited

FOREIGN PATENT DOCUMENTS

WO WO-2016071694 A2 * 5/2016 ..... C22C 1/02

OTHER PUBLICATIONS

NPL: on-line translation of CN-109097614-A, Dec. 2018 (Year: 2018).*
First Office Action for Chinese Patent Application No. 202011600476.0 dated Jan. 19, 2023, with correspondence from China Patent Agent (H.K.) Ltd summarizing Office Action; 8 pages.

* cited by examiner

GRAIN REFINER FOR MAGNESIUM-BASED ALLOYS

CROSS-REFERENCE TO RELATED APPLICATIONS

This application claims the benefit and priority of Chinese Application No. 202011600476.0, filed Dec. 30, 2020. The entire disclosure of the above application is incorporated herein by reference.

INTRODUCTION

This section provides background information related to the present disclosure which is not necessarily prior art.

The present disclosure relates to methods of making magnesium- or aluminum-based master alloy compositions with grain refining agents that may improve formability of a magnesium-based cast billet.

Lightweight metal components have become an important focus for manufacturing vehicles, especially automobiles, where continual improvement in performance and fuel efficiency is desirable. While conventional steel and other metal alloys provide various performance benefits, including high strength, such materials can be heavy. Lightweight metal components for automotive applications are often made of aluminum and/or magnesium alloys. Such lightweight metals can form load-bearing components that are strong and stiff, while having good strength and ductility (e.g., elongation). High strength and ductility are particularly important for safety requirements and durability in vehicles like automobiles.

While magnesium-based alloys are an example of lightweight metals that can be used to form structural components in a vehicle, in practice, the use of magnesium-based alloys may be limited. While magnesium-based alloys can be treated by a variety of different formation techniques, including those that involve high strain rates, like wrought processes such as extrusion, rolling, forging, flow forming, stamping, and the like, magnesium-based alloys are typically limited to processes that only experience low strain rates (e.g., less than 1/second) or else they may crack. It would be desirable to be able to form components for vehicles formed of materials comprising magnesium via a variety of high-strain rate processes. Thus, there is an ongoing need for improved formation processes to form improved lightweight metal components from magnesium-containing alloys.

SUMMARY

This section provides a general summary of the disclosure, and is not a comprehensive disclosure of its full scope or all of its features.

In various aspects, the present technology provides a master alloy including an alloy composition including magnesium (Mg) at a concentration of greater than or equal to about 1.00 wt. % to less than or equal to about 90 wt. %, boron (B) at a concentration of greater than or equal to about 0.01 wt. % to less than or equal to about 20 wt. %, and aluminum (Al) at a concentration of greater than or equal to about 0.1 wt. % to less than or equal to about 90 wt. %, wherein the alloy composition includes $MgB_2$ particles at a volume fraction greater than or equal to about 0.01% to less than or equal to about 20%.

In one aspect, the magnesium (Mg) has at a concentration of greater than or equal to about 80 wt. % to less than or equal to about 89.8 wt. %.

In one aspect, the boron (B) has at a concentration of greater than or equal to about 0.1 wt. % to less than or equal to about 10 wt. %.

In one aspect, the aluminum (Al) is at a concentration of greater than or equal to about 0.1 wt. % to less than or equal to about 10 wt. %.

In one aspect, the volume fraction of $MgB_2$ particles is greater than or equal to about 0.2% to less than or equal to about 10%.

In one aspect, a layer of $AlB_2$ is on a surface of at least one of the $MgB_2$ particles.

In various aspects, the present technology provides a magnesium-based master alloy comprising: magnesium (Mg), and a grain refiner including a grain refining substrate, and an adsorption layer, the adsorption layer being a nucleation site for magnesium (Mg), and a layer on the grain refining substrate.

In one aspect, the grain refining substrate is stable in a magnesium (Mg)-based melt.

In one aspect, the grain refining substrate has a density under 2.61 g/cm$^3$.

In one aspect, the adsorption layer is a monolayer on the grain refining substrate.

In one aspect, the adsorption layer has a lattice mismatch % of under 2% with the grain refining substrate.

In one aspect, the lattice mismatch % of the adsorption layer is under 1% with the magnesium (Mg).

In various aspects, the present technology also provides a method of forming a master alloy, the method including forming magnesium diboride ($MgB_2$) particles, adding the magnesium diboride ($MgB_2$) particles to a melt, the melt including aluminum (Al) and magnesium (Mg), agitating the melt such that aluminum diboride forms on a surface of the magnesium diboride ($MgB_2$) particles, and solidifying the melt.

In one aspect, the magnesium diboride ($MgB_2$) particles are formed by ball milling a mixture of boron (B) and magnesium (Mg) powders.

In one aspect, the magnesium diboride ($MgB_2$) particles are formed by adding boron (B) containing salts into a magnesium (Mg) melt and solidifying the magnesium (Mg) melt containing magnesium diboride ($MgB_2$) particles.

In one aspect, the method further including deforming the solidified melt by extruding or rolling, such that magnesium diboride ($MgB_2$) particles clusters are broken apart.

In one aspect, the Mg-based melt includes magnesium (Mg) at a concentration of greater than or equal to about 1.00 wt. % to less than or equal to about 90 wt. %, boron (B) at a concentration of greater than or equal to about 0.01 wt. % to less than or equal to about 20 wt. %, and aluminum (Al) at a concentration of greater than or equal to about 0.1 wt. % to less than or equal to about 90 wt. %, wherein the alloy composition includes $MgB_2$ particles at a volume fraction greater than or equal to about 0.01% to less than or equal to about 20%.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
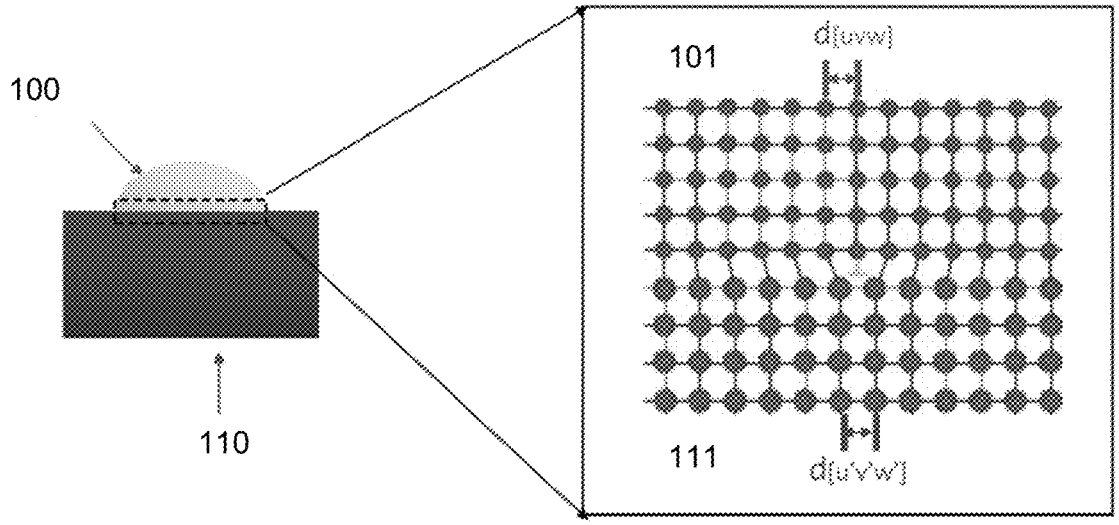
FIG. 1 illustrates a grain refining agent and magnesium grain nucleus according to example embodiments.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one-step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

The master alloy formed in accordance with certain aspects of the present disclosure are particularly suitable for use in various magnesium-based alloys used to form components of an automobile or other vehicles (e.g., motorcycles, boats, tractors, buses, motorcycles, mobile homes, campers, and tanks), but they may also be used in a variety of other industries and applications, including aerospace components, consumer goods, devices, buildings (e.g., houses, offices, sheds, warehouses), office equipment and furniture, and industrial equipment machinery, agricultural or farm equipment, or heavy machinery, by way of non-limiting example. Non-limiting examples of automotive components include hoods, pillars (e.g., A-pillars, hinge pillars, B-pillars, C-pillars, and the like), panels, including structural panels, door panels, and door components, interior floors, floor pans, roofs, exterior surfaces, underbody shields, wheels, control arms and other suspension, crush cans, bumpers, structural rails and frames, cross car beams, undercarriage or drive train components, and the like. The magnesium-based alloys that may use the master alloy may be one of AZ31B, AZ80, and/or AZ60, although the disclosure is not limited thereto.

In certain aspects, the present disclosure pertains to methods of making master alloys containing $MgB_2$ intermetallic compound. The methods provided herein enable the formation of components comprising magnesium-based alloys at high strain rates by use of a master alloy containing $MgB_2$ intermetallic compounds in forming the magnesium-based billet, which is beneficial for mechanical properties of the formed magnesium-based alloy components. Generally, magnesium-based alloys display anisotropic behavior and have insufficient deformation mechanisms during deformation and working, which can limit the options available for processing. The anisotropic deformation behavior can occur at least in part during forming of the desired shape of the articles at high-strain rates. Due to strong geometrical softening effects in magnesium-based alloys, strain localization tends to occur in domains with softer orientations during high-strain rate deformations, for example, due to large grain sizes, which can lead to severe cracking at early formation stages. Thus, magnesium-based alloys generally cannot be formed without cracking in manufacturing processes that involve high-strain rates.

Strain is generally understood to be a ratio of two lengths (initial and final) and thus a dimensionless value. Thus, a strain rate is in units of inverse time (such as $s^{-1}$). A high strain rate process may be considered to be one that applies a strain rate of greater than or equal to about 1/s to a material as it is being processed. High strain rate forming processes may include those processes selected from the group consisting of: high-speed rolling, flow forming, high-speed forging, ring rolling and combinations thereof. However, conventionally such high strain rate processes have been avoided when forming articles or components from magnesium-based alloys due to extensive cracking that occurs.

In accordance with certain aspects of the present disclosure, certain master alloys containing $MgB_2$ intermetallic compound may be combined with a magnesium-based alloy to form an advantageous microstructure in a preform that can subsequently be subjected to high strain rate processes without suffering from significant cracking. Suitable master alloys with grain refining agents have a composition comprising magnesium (Mg) at a concentration of greater than or equal to about 1.00 weight percentage (wt. %) to less than or equal to about 90 wt. %, boron (B) at a concentration of greater than or equal to about 0.01 wt. % to less than or equal to about 20 wt. %, aluminum (Al) at a concentration of greater than or equal to about 0.1 wt. % to less than or equal to about 90 wt. %, and a volume fraction of $MgB_2$ particles is greater than or equal to about 0.01% to less than or equal to about 20%. In some example embodiments, the magnesium (Mg) is at a concentration of greater than or equal to about 80 wt.% to less than or equal to about 99.8 wt. %, the boron (B) is at a concentration of greater than or equal to about 0.1 wt. % to less than or equal to about 10 wt. %, the aluminum (Al) is at a concentration of greater than or equal to about 0.1 wt. % to less than or equal to about 10 wt. %, and a volume fraction of $MgB_2$ particles is greater than or equal to about 0.2% to less than or equal to about 10%. Weight percent (wt. %) or mass percent, is the weight of a component divided by the weight of the overall alloy composition multiplied by 100. For example, 3 pounds of boron in a 100-pound sample of magnesium alloy would have a weight percent of 3.

In accordance with certain aspects of the present disclosure, certain master alloys containing $MgB_2$ intermetallic compound may be combined with a magnesium-based alloy to form an advantageous microstructure in a preform that can subsequently be subjected to high strain rate processes without suffering from significant cracking. Suitable master alloys with grain refining agents have a composition comprising magnesium (Mg) at a concentration of greater than or equal to about 1.00 weight percentage (wt. %) to less than or equal to about 90 wt. %, boron (B) at a concentration of greater than or equal to about 0.01 wt. % to less than or equal to about 20 wt. %, aluminum (Al) at a concentration of greater than or equal to about 0.1 wt. % to less than or equal to about 90 wt. %, and a volume fraction of $MgB_2$ particles is greater than or equal to about 0.01% to less than or equal to about 20%. In some example embodiments, the magnesium (Mg) is at a concentration of greater than or equal to about 80 wt. % to less than or equal to about 89.8 wt. %, the boron (B) is at a concentration of greater than or equal to about 0.1 wt. % to less than or equal to about 10 wt. %, the aluminum (Al) is at a concentration of greater than or equal to about 0.1 wt. % to less than or equal to about 10 wt. %, and a volume fraction of $MgB_2$ particles is greater than or equal to about 0.2% to less than or equal to about 10%. Weight percent (wt. %) or mass percent, is the weight of a component divided by the weight of the overall alloy composition multiplied by 100. For example, 3 pounds of boron in a 100-pound sample of magnesium alloy would have a weight percent of 3.

Other elements that are not described herein can also be included in trace amounts, i.e., amounts of less than or equal to about 1.5 wt. %, less than or equal to about 1 wt. %, less than or equal to about 0.5 wt. %, or amounts that are not detectable, provided that they do not materially affect the basic and novel characteristics of the steel alloy. For example, impurities may be present at less than or equal to about 0.1 wt. %, optionally less than or equal to about 0.05 wt. %, and in certain variations, optionally less than or equal to about 0.01 wt. % of the master alloy. A balance of the master alloy may be magnesium (Mg).

In some example embodiments, the master alloy consists essentially of Mg, B, and Al.

Such master alloys may have the capability of forming intermetallic species, during the casting. The intermetallic compounds may act as grain refiners. In certain aspects, the intermetallic species may have a composition selected from the group consisting of $MgB_2$, $AlB_2$, and combinations thereof. The grain refiners may assist in forming magnesium alloy grains during casting, increasing the number of magnesium alloy grains, and thereby assisting in forming smaller magnesium alloy grains. The grain refiners can remain stable during the high temperature casting process of the magnesium-based alloy, for example, at temperatures of greater than or equal to about 700° C. The grain refiners may include a duplex nucleation mechanism described in further detail below. The present disclosure contemplates forming smaller microstructures during casting to enable high-strain-rate deformation processing. In such microstructures, strain localization induced by geometrical softening is impeded by grain size.

In certain variations, the present disclosure provides a method of forming a casting (e.g., billet, slab, cast-to-size article, and the like) made of a master alloy, like those described above, which include grain refiners comprising thermally stable intermetallic species. The forming includes producing magnesium diboride ($MgB_2$) particles. In some example embodiments producing a magnesium diboride ($MgB_2$) particles may be performed by ball milling of a mixture of boron and magnesium powders to create the magnesium diboride ($MgB_2$) particles. Other suitable methods for mixing the boron and magnesium powders may be used to produce magnesium diboride ($MgB_2$) particles. In some example embodiments, the magnesium diboride ($MgB_2$) particles may be produced by adding boron-containing salts to a melt primarily comprising magnesium and solidifying the melt after the formation of magnesium diboride ($MgB_2$) particles. The magnesium diboride ($MgB_2$) particles may be added to a master melt primarily comprising aluminum and magnesium to achieve the concentrations of magnesium diboride ($MgB_2$) particles, magnesium, boron, and aluminum as disclosed above. The master melt may be stirred to accelerate the reaction between aluminum and magnesium diboride ($MgB_2$) particles to form aluminum diboride ($AlB_2$) on a surface of magnesium diboride ($MgB_2$) particles. The master melt and stirring may be conducted in an environment having a temperature of greater than or equal to about 650° C. to less than or equal to about 900° C., optionally greater than or equal to about 650° C. to less than or equal to about 760° C. Other methods of agitation may be used to accelerate to formation of the aluminum diboride ($AlB_2$). The master melt may then be solidified into, for example, a cast billet. The master alloy cast billet may then be further processed to deform the casting to produce a rod, wire, and/or sheet of the master alloy.

In certain variations, the magnesium, boron, and aluminum may form intermetallics that may be grain-refining agents. These grain-refining agents should be stable in the magnesium-based alloy melt, have a density approximately the same as the magnesium-based alloy melt, and have a low interfacial energy between the grain refining agents and magnesium. The magnesium-based melt may be cast into a billet and be an alloy disclosed above, for example, AZ80, or the like. For example, the grain-refining agent should be stable in the magnesium-based alloy melt such that the grain-refining agent does not melt, dissolve, evaporate, or otherwise cease to exist before the magnesium-based alloy melt may be cast into a billet or the like. In some example embodiments, the grain-refining agent may have a density approximately greater than or equal to 0.5 times the density of magnesium to less than or equal to 1.5 times the density of magnesium. This is because the grain-refining agent needs to be present during casting to promote grain nucleation during cooling of the billet or the like. Further, the density should be approximately the same as the magnesium-based alloy melt in order for the grain-refining agents to be dispersed in the magnesium-based alloy melt. For example, if the density was too heavy or too light compared to magnesium then the grain-refining agents may gather at one level of the magnesium-based melt used in component forming and not promote adequate grain nucleation.

Additionally, a low interfacial energy between the grain-refining agent and the magnesium is beneficial; otherwise, the grain-refining agent may not promote nucleation.

FIG. 1 illustrates a grain refining agent and magnesium grain nucleus according to example embodiments. FIG. 1 shows how a magnesium nucleus 100 may solidify on a surface of grain refining substrate 110 during solidification of a magnesium melt.

Interfacial energy may be understood as the mismatch between crystal lattices of adjacent structures. As shown in FIG. 1, the mismatch may be represented by the differences in the magnesium alloy crystal 101 and the grain refining substrate crystal 111. The magnesium alloy crystal 101 may be the portion of the magnesium nucleus 100 directly contacting the grain refining substrate 110, and the grain refining substrate crystal 111 may be the portion of the grain refining substrate 110 directly contacting the magnesium nucleus 100. The magnesium alloy crystal 101 may have an interatomic spacing period d[uvw], and the grain refining agent crystal 201 may have an interatomic spacing period of d[u'v'w']. The mismatch between d[uvw] and d[u'v'w'] should be less than or equal to 2%, and in some example embodiments, less than or equal to 1%, and in some further example embodiments, less than or equal to 0.9%, 0.8%, 0.7%, 0.6%, 0.5%, 0.4%, 0.3%, 0.2%, 0.1% or 0%.

Table 1, below, shows a number of intermetallic compounds compared to magnesium to determine their suitability as grain refining agents.

TABLE 1*

Lattice mismatch with Mg, density and stability comparison according to example embodiments.

| Formula | Mismatch (%) | Density (g/cm3) | Stable at 923-1033K |
|---|---|---|---|
| Mg | / | 1.74 | / |
| $TiB_2$ | **<1%** | 4.52 | **Yes** |
| $VB_2$ | **0.2%** | 5.1 | **Yes** |
| $Al_2Y$ | **0.65%** | *3.91* | N/A |
| $Al_2Ce$ | **1.4%** | 5.43 | No |
| $Al_2Gd$ | **0.13%** | 5.69 | N/A |
| $Al_2Sm$ | **0.45%** | 5.41 | N/A |
| $Al_2Dy$ | **0.96%** | 5.98 | N/A |
| $ZrB_2$ | **1.2%** | 6.08 | **Yes** |
| $AlB_2$ | **0.6%** | *3.19* | No |
| $Al_2Ca$ | **2%** | **2.42** | No |
| $Al_4C3$ | *3.4%* | **2.36** | **Yes** |
| SiC | *5%* | *3.21* | No |

*Bold represents passing value, italics represents the boundaries of acceptable, and underlining represents unacceptable values As may be seen in table 1, above, single compounds may not be able to meet the three considerations discussed above. While the lattice mismatch may be acceptable in the comparative examples of table 1, the density and/or stability is unacceptable.

Figure 2:
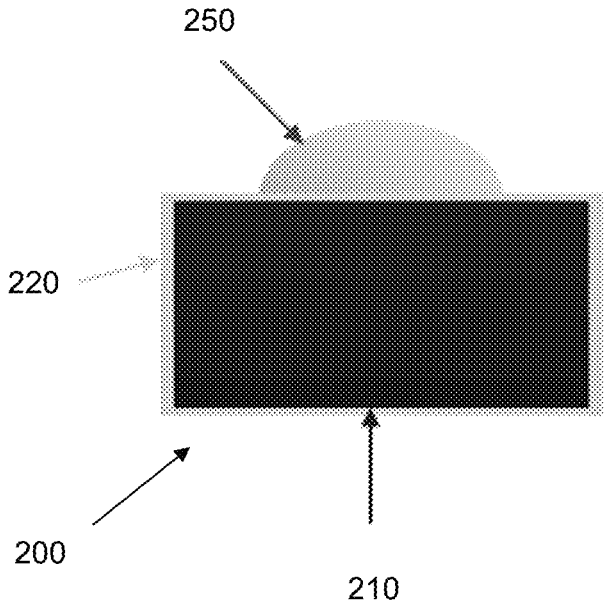
FIG. 2 illustrates a duplex nucleation mechanism according to some example embodiments.

FIG. 2 illustrates a duplex nucleation mechanism according to some example embodiments.

In some example embodiments, to achieve acceptable density, lattice mismatch, and stability, a duplex nucleation mechanism may be used. In some example embodiments, a grain-refining agent 200 may include a grain refining substrate 210 including a first intermetallic, and an adsorption layer 220 on an outer surface of the grain refining substrate including a second intermetallic. A magnesium nucleus 250 may solidify on a surface of grain refining agent 200, and specifically, a surface of the adsorption layer 220, during solidification of a magnesium melt.

In some example embodiments, the first intermetallic may have a density that is acceptable, and is stable at magnesium-alloy melting temperatures as discussed above. Further, the intermetallic may have a poor lattice mismatch, for example less than or equal to 5%, or less than or equal to 4.5%. The first intermetallic may then be stable and well dispersed in the magnesium-based melt. The first intermetallic may be, for example, magnesium diboride ($MgB_2$).

In some example embodiments, the second intermetallic may not be stable at magnesium-alloy melting temperatures, and may have a density that is less than or equal to 2 times the density of magnesium. However, the second intermetallic may also have a very good lattice mismatch, for example, less than or equal to 1%, or less than or equal to one of 0.9%, 0.8%, 0.7%, 0.6%, 0.5%, 0.4%, 0.3%, 0.2%, 0.1% or 0%. The second intermetallic may be, for example, aluminum diboride ($AlB_2$).

Table 2, below, shows magnesium diboride ($MgB_2$) and aluminum diboride ($AlB_2$) compounds compared to magnesium to determine their suitability as grain refining agents.

TABLE 2**

Lattice mismatch, density and stability comparison according to example embodiments.

| Formula | Lattice Mismatch (%) | Density (g/cm3) | Stable at 923-1033K? |
|---|---|---|---|
| Mg | / | 1.74 | / |
| $MgB_2$ | *4.3%* | **2.57** | **Yes** |
| $AlB_2$ | **0.6%** | *3.19* | No |

**Bold represents passing value, italics represents the boundaries of acceptable, and underlining represents unacceptable values In some example embodiments, this may allow for the grain refining substrate to be well dispersed in the magnesium-based melt, and for the adsorption layer to form on the grain refining substrate as the second intermetallic segregates to the grain refining substrate. The second intermetallic may segregate to a surface of the grain refining substrate. In some example embodiments, as the second intermetallic forms the adsorption layer, the adsorption layer be arranged to form a stable layer of the second intermetallic on the surface of the grain refining substrate. Simply, the adsorption layer may be stable as a layer on the grain refining substrate while the second intermetallic of the adsorption layer may not be stable without the grain refining substrate. In some example embodiments, the adsorption layer is a monolayer, or a layer of one molecule, of the second intermetallic. In some example embodiments, the adsorption layer may be several layers of molecules of the second intermetallic. Further, the adsorption layer may be a complete layer surrounding the grain refining substrate, or may be an incomplete layer on the outer surface of the grain refining substrate.

In some example embodiments, the adsorption layer having a much smaller lattice mismatch than the grain refining substrate may greatly improve the nucleation potency of the grain-refining agent. As such, the grain-refining agent having a grain refining substrate and an absorption layer may promote growth of smaller grain sizes, improving formability of the magnesium-based alloy.

Figure 3:
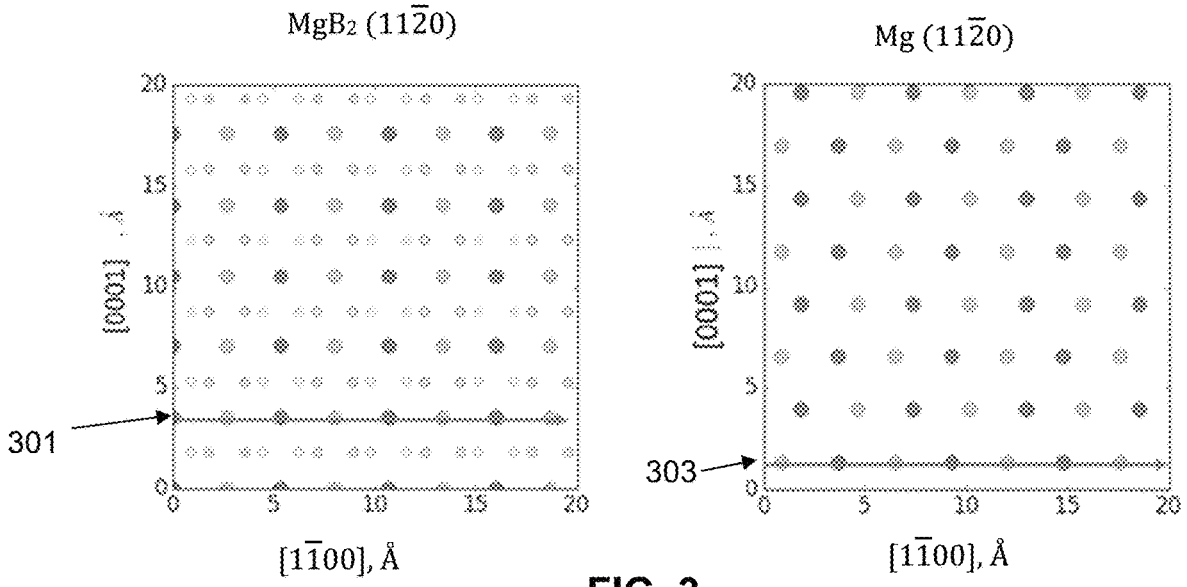
FIGS. 3 and 4 illustrates a lattice comparison between magnesium diboride ($MgB_2$), aluminum diboride ($AlB_2$), and magnesium (Mg), according to some example embodiments.
Figure 4:
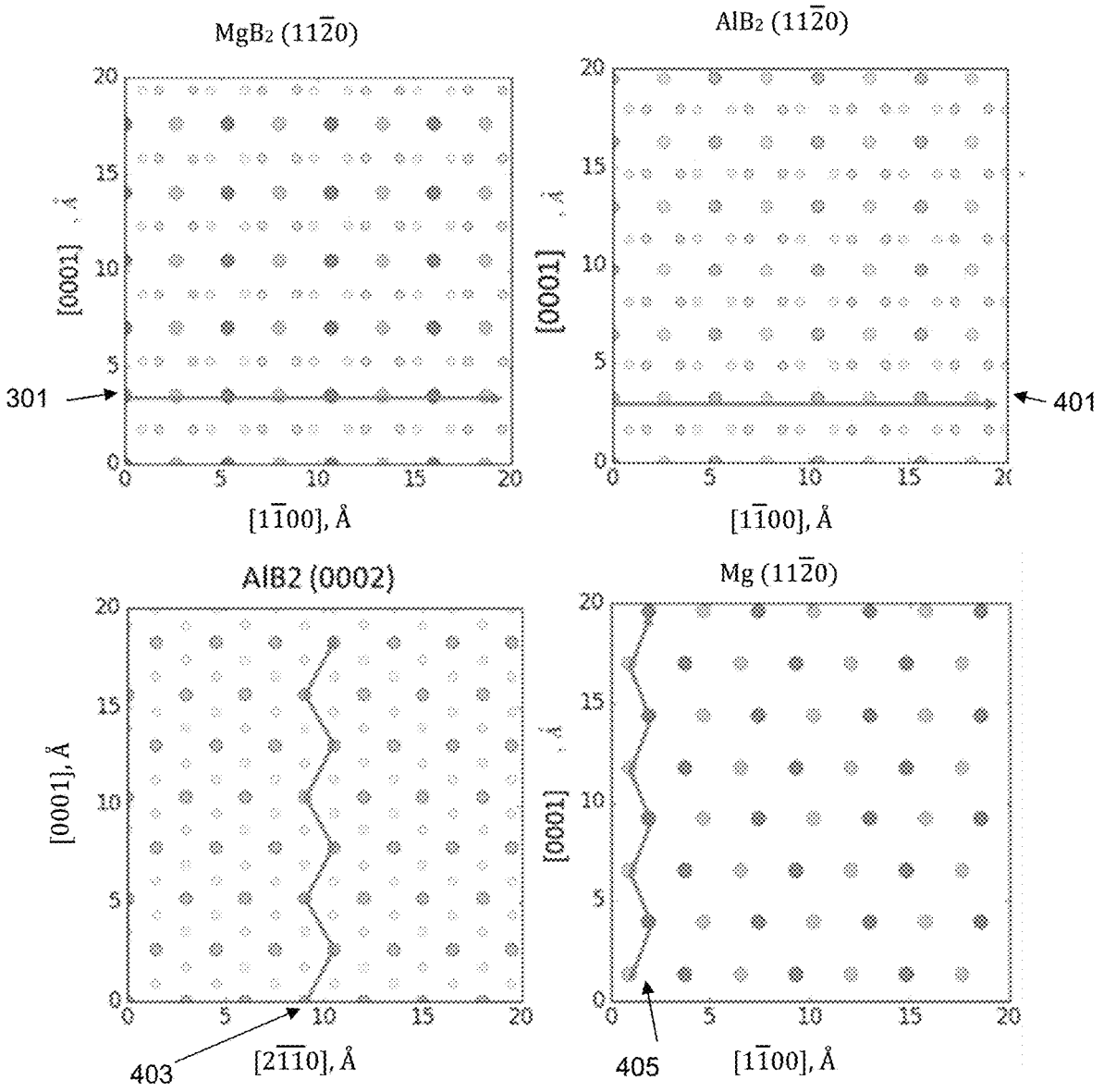

FIGS. 3 and 4 illustrates a lattice comparison between magnesium diboride ($MgB_2$), aluminum diboride ($AlB_2$), and magnesium (Mg), according to some example embodiments.

The lattice representations of FIG. 3 show the (11$\bar{2}$0) plane along the and [0001] and [1$\bar{1}$00] directions of magnesium diboride ($MgB_2$) and magnesium (Mg). The lines 301 and 303 represent the point of closest lattice match between magnesium diboride ($MgB_2$) and magnesium (Mg), respectively, in FIG. 3. The lattice mismatch of magnesium diboride and magnesium is about 4.3%. As discussed above, this may be a poor match for a grain-refining agent.

However, when introducing the second intermetallic of the adsorption layer, the lattice mismatch between the magnesium and the grain-refining agent may be improved. The magnesium diboride and the aluminum diboride offer excellent lattice mismatch along [1$\bar{1}$00] direction on (11$\bar{2}$0) plane, with a 2.5% lattice mismatch between lines 301 and 401 of the magnesium diboride and the aluminum diboride, respectively. Further, the aluminum diboride and magnesium offer an excellent lattice mismatch along [0001] directions on the (0002) plane of the aluminum diboride and the (11$\bar{2}$0) plane of the magnesium, with a 0.6% lattice mismatch between lines 403 and 405 of the aluminum diboride and magnesium, respectively.

In some example embodiments, the aluminum diboride may readily form a layer on the magnesium diboride substrate due to the low interfacial energy and be stable, and in turn, the magnesium may then nucleate on the aluminum diboride due to the low interfacial energy. As a result, the magnesium may grow more grains in a cast billet, and/or may have smaller grains in the cast billet.

Figure 5:
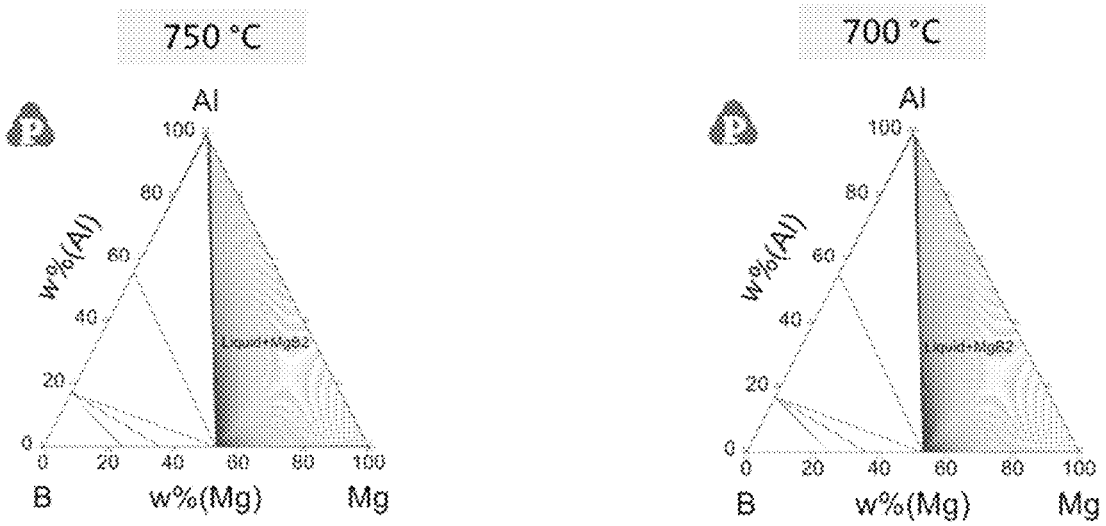
FIG. 5 illustrates triangular phase diagrams of aluminum, boron, and magnesium at different melting temperatures, according to some example embodiments.

FIG. 5 illustrates triangular phase diagrams of aluminum, boron, and magnesium at different melting temperatures, according to some example embodiments.

The two triangular phase diagrams of FIG. 5 illustrate that magnesium diboride ($MgB_2$) may be present while the remaining metals are in liquid form in the shaded portion 501 of the triangular phase diagrams at 750° C. and 700° C. This corresponds with a magnesium based alloy including between 0.1 wt. % and 90 wt. % aluminum, between 0.01 wt. % and 50 wt. % boron, with magnesium being the remainder, and the magnesium diboride particles being between 0.01% and 20% of the volume fraction.

Figure 6:
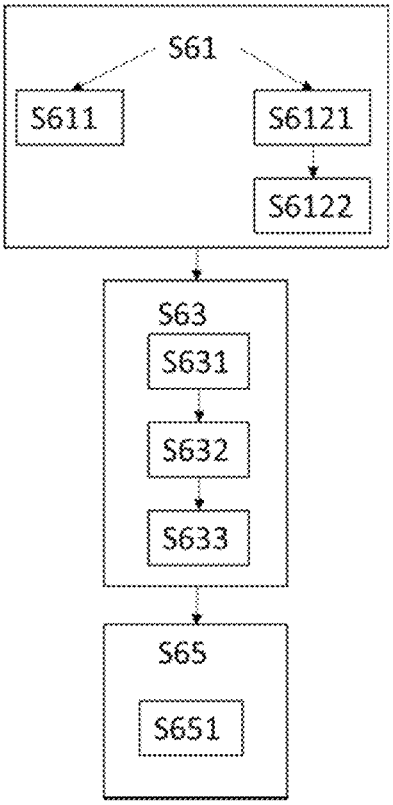
FIG. 6 illustrates a flowchart illustrating the forming of a master alloy according to some example embodiments.

With reference to FIG. 6, the current technology provides a method 60 of fabricating a master alloy, which may be used in a magnesium-based alloy automobile component. More particularly, the method includes an operation S61 for forming magnesium diboride ($MgB_2$) particles. In some example embodiments, the magnesium diboride particles may be formed in an operation S611 by performing ball milling of a mixture of boron and magnesium powders to create the magnesium diboride ($MgB_2$) particles. However, other suitable methods for mixing the boron and magnesium powders may be used to produce magnesium diboride ($MgB_2$) particles. In some other example embodiments, the magnesium diboride ($MgB_2$) particles may be produced in an operation S6121 by adding boron-containing salts to a melt primarily comprising magnesium and an operation S6122 solidifying the melt after the formation of magnesium diboride ($MgB_2$) particles. The method further includes a master melting operation S63. The master melting operation S63 may include an operation S631 in which the magnesium diboride ($MgB_2$) particles formed in operation S61 may be added to a master melt primarily comprising aluminum and magnesium to achieve the concentrations of magnesium diboride ($MgB_2$) particles, magnesium, boron, and aluminum as disclosed above. In an operation S632, the combined master melt may be stirred to accelerate the reaction between aluminum and magnesium diboride ($MgB_2$) particles to form aluminum diboride ($AlB_2$) on a surface of magnesium diboride ($MgB_2$) particles. The master melt and stirring may be conducted in an environment having, for example, a temperature of greater than or equal to about 650° C. to less than or equal to about 900° C., optionally greater than or equal to about 650° C. to less than or equal to about 760° C. However, the example embodiments are not limited thereto and other methods of agitation may be used to accelerate to formation of the aluminum diboride ($AlB_2$). In an operation S633 the master melt may then be solidified into, for example, a cast billet. The method may further include an optional operation S65 including an operation S651 in which the master alloy cast billet may then be further processed to deform the casting to produce a rod, wire, and/or sheet of the master alloy.

In this manner, a master alloy component containing grain-refining agents may formed for use in a magnesium-based alloy that is substantially free of cracking. The term "substantially free" as referred to herein means that while minor microscale cracking may occur, significant cracking defects are absent in the component after high-strain deforming to the extent that undesirable physical properties and limitations attendant with the presence of macroscale cracks are avoided (e.g., loss of strength, failure and damage, and the like). While the master alloy may be used in magnesium-based alloy components provided by the present disclosure are particularly suitable for use as components in an automobile or other vehicles (e.g., motorcycles, boats, tractors, buses, motorcycles, mobile homes, campers, and tanks), they may also be used in a variety of other industries and applications, including aerospace components, consumer goods, devices, buildings (e.g., houses, offices, sheds, warehouses), office equipment and furniture, and industrial equipment machinery, agricultural or farm equipment, or heavy machinery, by way of non-limiting example. Certain suitable automotive components formed of the magnesium-based alloy using the above master alloy component treated in accordance with the present methods include those selected from the group consisting of: an internal combustion engine component, a valve, a piston, a turbocharger component, a rim, a wheel, a road wheel, a ring and combinations thereof.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A master alloy comprising:

an alloy composition including magnesium (Mg) at a concentration of greater than or equal to 1 wt. % to less than or equal to 90 wt. %;

boron (B) at a concentration of greater than or equal to 0.01 wt. % to less than or equal to 20 wt. %; and aluminum (Al) at a concentration of greater than or equal to 0.1 wt. % to less than or equal to 90 wt. %, wherein the alloy composition includes $MgB_2$ particles at a volume fraction greater than or equal to 0.01% to less than or equal to 20%, and wherein a layer of $AlB_2$ completely surrounds an entire outer surface of at least one of the $MgB_2$ particles.

2. The master alloy according to claim 1, wherein the magnesium (Mg) is at a concentration of greater than or equal to 80 wt. % to less than or equal to 89.8 wt. %.

3. The master alloy according to claim 1, wherein the boron (B) is at a concentration of greater than or equal to 0.1 wt. % to less than or equal to 10 wt. %.

4. The master alloy according to claim 1, wherein the aluminum (Al) is at a concentration of greater than or equal to 0.1 wt. % to less than or equal to 10 wt. %.

5. The master alloy according to claim 1, wherein volume fraction of $MgB_2$ particles is greater than or equal to 0.2% to less than or equal to 10%.

* * * * *